US008899411B2

(12) United States Patent
Van Geer

(10) Patent No.: US 8,899,411 B2
(45) Date of Patent: Dec. 2, 2014

(54) HOLDER FOR CREDIT CARDS

(75) Inventor: René Johan Van Geer, AJ Rijswijk (NL)

(73) Assignee: R.J. van Geer Beheer bv, Rijswijk (NL)

( * ) Notice: Subject to any disclaimer, the term of this patent is extended or adjusted under 35 U.S.C. 154(b) by 297 days.

(21) Appl. No.: 13/322,672

(22) PCT Filed: May 26, 2010

(86) PCT No.: PCT/NL2010/050314

§ 371 (c)(1), (2), (4) Date: Nov. 28, 2011

(87) PCT Pub. No.: WO2010/137975

PCT Pub. Date: Dec. 2, 2010

(65) Prior Publication Data

US 2012/0067747 A1 Mar. 22, 2012

(30) Foreign Application Priority Data

May 27, 2009 (NL) ..... 1036993

(51) Int. Cl.
*A45C 11/18* (2006.01)

(52) U.S. Cl.
CPC ..... *A45C 11/182* (2013.01)
USPC ..... 206/39.4; 206/39.5

(58) Field of Classification Search
CPC ..... A45C 11/18; A45C 11/182; A45C 2001/065; B65D 83/12
USPC ..... 206/39, 39.4, 39.5, 38, 449, 555
See application file for complete search history.

(56) References Cited

U.S. PATENT DOCUMENTS

| | | | | | |
|---|---|---|---|---|---|
| 415,457 | A * | 11/1889 | Hart | 206/39.5 |
| 912,110 | A * | 2/1909 | Gill | 206/39.5 |
| 1,670,343 | A * | 5/1928 | Clemens | 206/39.5 |
| 5,125,505 | A * | 6/1992 | Kurosaki | 206/39.4 |
| 5,718,329 | A | 2/1998 | Ippolito et al. | |
| 6,230,879 | B1 * | 5/2001 | Lin | 206/39.4 |
| 7,004,312 | B2 * | 2/2006 | Chen | 206/39.5 |
| 7,857,022 | B2 * | 12/2010 | Kraml | 150/149 |
| 2005/0224149 | A1 | 10/2005 | Tiscione | |

FOREIGN PATENT DOCUMENTS

EP 0287532 10/1988

OTHER PUBLICATIONS

International search report dated Apr. 5, 2011 in corresponding PCT/NL2010/050314.

* cited by examiner

*Primary Examiner* — Jacob K Ackun
(74) *Attorney, Agent, or Firm* — Young & Thompson

(57) ABSTRACT

A holder for cards, including a housing which tightly fits around a stack of at least three cards and has at least one card opening to locate and remove cards, while opposite the card opening in the housing there is a card remove feature through which the cards through the card opening can be slid out the housing, characterized in that at the inner side of the housing near the card opening at least one side a friction element is provided which exerts a friction force to the bearing side of each individual card which is at least partly contained in the housing, with the result that the card has such a stable position relative to the housing, that the card can not slide due to gravity, but indeed due to a with the finger tips exerted force.

3 Claims, 3 Drawing Sheets

FIG 6
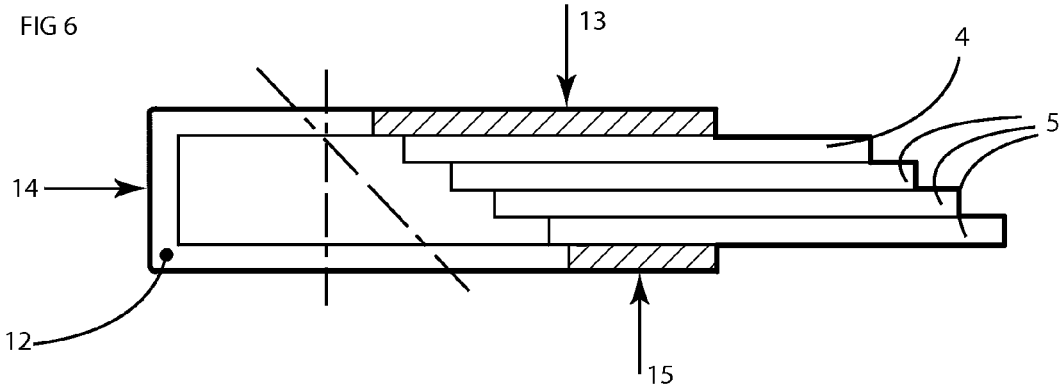
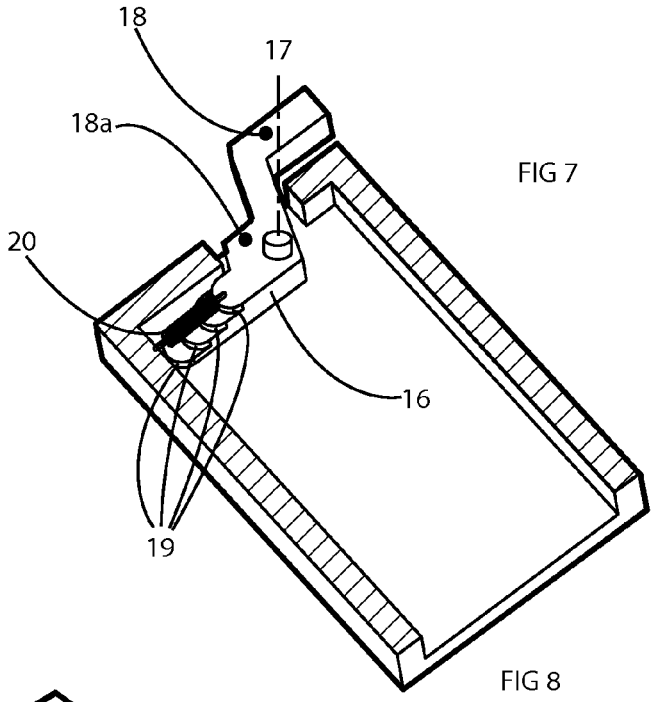
FIG 7
FIG 8
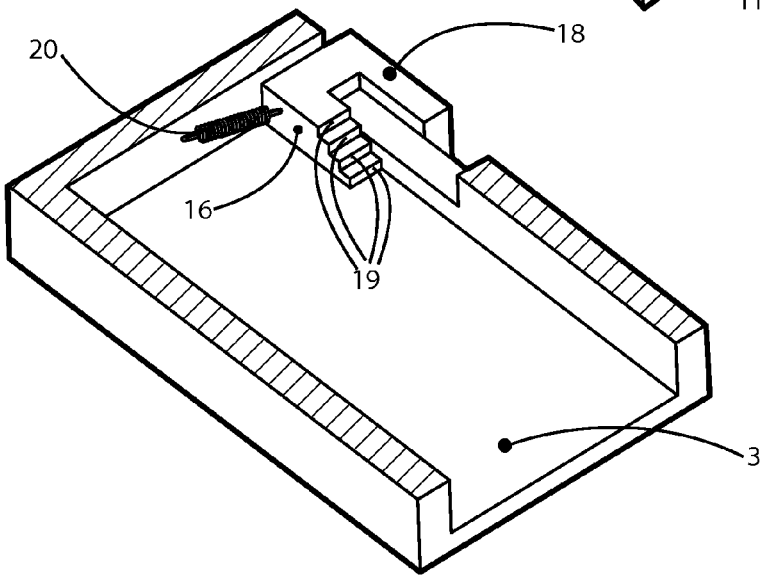

HOLDER FOR CREDIT CARDS

BACKGROUND OF THE INVENTION

The invention relates to a holder for credit cards and different items with dimensions comparable to credit cards, further referred to as "cards".

For the so called credit card format the main dimensions suffice ISO 7810 and the thickness and roundings suffice ISO 7813. This format is used for many cards with different applications: bank cards, driving licences, ID-cards, membership cards, entrance cards, reduction cards, savings cards, etc.

Wallets are provided with special pockets, but this solution to store cards has several disadvantages. The leather or artificial leather can by chemical interaction attack the cards and make them brittle, causing cracking or breaking. Because of the flexibility the cards can become curved and defect in the pockets. If for each card an individual pocket is used, the card package will be thicker then required. If several cards together are stored in a single pocket, selecting and removing of the desired card becomes complicated. Dust and sand granules in the pocket causes additional card wear.

Apart from wallets the prior art also discloses specific holders for cards. These card holders do not solve all of the above mentioned problems in their attempts to create a device in which the correct card can be easily selected.

Document NL 1.000.970 shows an optimally compact device wherein the cards are stacked and are stored in a tightly surrounding housing. The front and back of this housing are mutually pivoting while a spring mechanism presses against the back card. The cards are permanently staggered in the stack. The first effect of this staggered stack is that through an opening in the housing a narrow edge (approx. 1 to 2 mm) of the card is visible. The second effect, in combination with the spring which presses against the back card, is that the user has the power to, if the housing pivots open, simply "browse" through the card stack to select the correct card. The disadvantage of this device is the fact that manipulation of this device is not intuitive and requires some kills.

Document EP-A 0 287 532 shows a holder on the basis of a flat box or sleeve like housing, wherein the cards are stacked in register. This housing has an internal stepped push arm which by means of a button at the front can rotate relative to the housing manually, with the effect that the stack of cards slides outwards in staggered format because the push edge pushes against an edge. As soon as the arm is turned back to the initial position, the cards, by gravity, slide back into the housing to obtain the initial position.

This solution is still not optimal. Removing of the desired card from the projecting stack and from the housing is not easy. It is impossible to browse the card stack. Removing a card thus takes place by picking the desired card by the finger tips, but in the outwardly slid card stack only a small edge for each card is available for this manipulation. The card stack must in the outwardly slid position be permanently supported by the stepped arm. Accordingly, the cards from said outward slid position can not be slid back individually to enlarge the edge to grab the card to be removed to make the card more easily removable.

BRIEF SUMMARY OF THE INVENTION

The object of the invention is to provide a card holder that solves at least some of the aforementioned problems.

The invention is based on the fact that cards of credit card format indeed have a standardised dimension, but this dimension has always some dispersion due to unavoidable fabrication tolerances. Against the side of a stack of not equally wide cards a blade spring, for example, only bears against the edges of the widest cards, rather than against all cards. The inventive friction element is for that reason designed such that it not only engages oversized cards in the stack, but also undersized cards, even if an oversized card is stacked between two undersized cards. With a stack of three or more cards in the holder all with slightly different widths the friction element is nevertheless sufficiently engaged with all cards individually to avoid a card's accidentally moving from the holder.

Preferably the friction element has one or more of the following features: a surface of sufficient width/dimension to simultaneously engage all cards in the stack, thus e.g. extending substantially the complete height of the space of the card holder in which the card stack is received; a surface which is not rigid, and/or is indeed locally, preferably elastically, compressible, and/or in which preferably elastically a relief can be made, and/or in which easily, preferably elastically, one or more grooves or pits can be made, and/or which can be deformed like the surface of a wadded pillow or felt layer, and/or which easily yields locally, and/or is easily, preferably elastically, deformable, and/or easily adapts in shape to the shape, such as the relief, of the surface of the side of a card stack, which side is pressed against the surface of the friction element. Preferably with these features it is provided that the friction element and the individual edges of all cards in the stack properly connect such that the friction element engages properly each individual edge of all cards in the stack to exert sufficient friction force to hold each card of the stack without the ability to slide from the holder by gravity only.

It will be appreciated that the friction element preferably engages the side of each card, thus the narrow side of the card of which the dimension is provided by the card thickness. Thus between the card and the friction element a force acts in the direction parallel to the top face of the card, wherein the top face is provided by the length and width of the card. A card has a top face and opposite to it a back face of equal dimension and has four sides having the same thickness as the card thickness. A card stack has a top face and opposite to it a back face of equal dimension and has four sides having the same thickness as the stack thickness.

Document EP-A0287532 shows the possibility to clamp the card stack in the housing by means of one or more blade springs which exert force against the narrow side of the cards, such that the cards by inclined position of the housing will not slide from the housing. Such blade springs are known from the application in holders for individual cards, but in operation they do not provide the correct clamping for stacked cards. Blade springs bear against only the widest card in the stack, allowing narrower cards to become loose.

U.S. Pat. No. 5,718,329 discloses a sleeve like card holder that is open at both ends with a pressing spring pressing the top face of a card stack to prevent the cards from falling from the holder. The cards can wear fast in such a holder because of the top face engaging pressing spring. A card removing feature, like the push arm of EP-A 0 287 532 is lacking. The design is such to push the card stack from the sleeve with a finger.

Friction elements are also mentioned in the documents NL 1.002.759 and US 2005/0224149A1. In both documents the functionality is however limited to the situation in which the cards are completely in the housing and the friction element is designed to prevent the cards from falling from the housing only at moments when the card holder is not in use. As soon as the cards partly project from the holder to select a card and remove it individually, the cards are remote from engagement with the friction elements and the friction element is thus no longer effective to prevent cards from falling from the holder. In document NL 1.002.759 the friction force is furthermore not limited to a force component in the plane of the cards, but also comprises a component perpendicular to this plane, by which the cards are pressed onto each other and the friction between the cards plays an important role.

In the present invention the force component perpendicular to the card plane is preferably avoided, in favor of the second and completely new feature of the card holder, namely the possibility for the user to, after the card stack is partly slid from the housing, select an individual card, mutually shift cards in the stack, wherein only the card against which the user pushes with the finger tips, will move, while the other cards at that time keep their position relative to the housing.

According to one embodiment the friction element in the housing of the card holder is a substrate with a rough fibre like surface structure. If fibres with a large density project from the surface, a good and intensive contact will arise between the friction element and each individual card in the bearing card stack. Even if a fibre of a smooth material, like polyamide is used, the friction between cards and friction element is sufficiently large to facilitate the above mentioned user operations.

The level of the friction on the cards during sliding, is directly proportional to the normal force with which the cards push against the friction element. This normal force will remain active throughout the complete service life of the holder, frequently many years. While the normal force at the friction element increases, the risk increases that the fibres will wear or permanently deform, thus the friction force could decrease after some time. To optimise the life it is desirable to limit the pressure of the cards at the friction element. If at given normal force the surface of the friction element is increased, the load to the individual fibres in the friction element will decrease and the life of the friction element will increase, while the friction force to the cards will stay the same. It is however preferred to design the friction element from a material which does not relax at permanent load, like e.g. a felt of metal fibres.

An embodiment of a holder according to the invention comprises at the inner side of the housing directly opposite the friction element a resilient element, e.g. a blade spring, with the effect that the above mentioned normal force at the friction element will stay within determined limits, despite the tolerances of the dimensions of the housing and cards.

A different embodiment of the holder according to the invention is obtained if the friction element and the resilient element are assembled into a single resilient friction element.

If within the housing against the side opposite the resilient friction element a second, resilient or not resilient, friction element is applied, an embodiment is obtained of the holder of the invention with two novel advantages. First twice as much tolerance of the width dimension of the cards is allowed, which leads to a further optimisation of the grip at each individual card. Second, while the effective friction is maintained, the pressure per friction element can be halved relative to the situation with a friction element at only one side, whereby the life of the friction element increases.

An embodiment of the holder of the invention wherein the assembly of the friction element, resilient element and/or resilient friction element in the housing is simplified, comprises at the inner side of the housing at convenient positions grooves where these elements can be located in stable manner.

The card remove feature gives the opportunity to partly slide the card stack from the housing. This is a required operation before the user can select a card and remove it from the housing.

An embodiment of a card remove feature as part of a card holder of the invention is made from a recess in the housing which offers sufficient space to push with a finger the card stack partly out of the housing through the card opening.

If this recess extends continuously across three faces, first the front, second the back opposite the card opening and third the back opposite the front, while the recess in the front is less deep compared to the recess in the back, the finger with which the stack is pushed from the housing, end this push movement in an inclined position relative to the front and back, whereby the card stack is step like slid out of the housing.

If the card in a stepped stack is slid from the housing, each card shows a narrow edge and the user can see at a glance which cards are present in the holder. Also the user can easily and quickly select within the card stack the desired card and remove it by manually sliding these cards mutually in a direction equal to or opposite the direction in which the cards are slid from the housing from their stored position An embodiment of the card remove feature of the invention comprises a step like element, which by the user relative to the housing, e.g. by means of rotation or translation, can be moved against the card stack, wherein the individual steps of the step like element exert at the individual cards in the stack in the direction of the card opening a force, resulting in that the card stack slides outward in stepped shape. The steps have a thickness which is measured parallel to the card thickness and a spacing which is measured perpendicular to the thickness and which determines the degree wherein the cards slide mutually if they slide in stepped shape from the housing.

An embodiment of the step like element has steps with a thickness of approx. 0.4 mm. For modular nature approx. 0.4 mm is a sufficient thickness for the step, since this equals approx. half a typical card thickness (approx. 0.8 mm) and approx. one third of the thickness of a card with embossing (approx. 1.2 mm). If the stepped element pushes against the card stack, within a card stack with thickness 0.8 mm each subsequent card will skip one step and after an embossed card two steps are skipped. The first and last step may not be an exception to this and obtain a thickness of e.g. approx. 0.8 mm, since the first and last step in operation will never bear against a halve card thickness.

The spacing of the steps depends on the maximum number of cards that can be stored in the housing. The maximum length of the step like element is limited and the spacing between the steps is spread over this available length. The stepped element in the housing for a small card stack can obtain a lager spacing compared to a housing for a larger card stack.

An embodiment of the moving step like element in the card remove feature of the card holder of the invention, is provided with a reset spring, with the effect that this step like element after operation will always immediately and automatically return to the initial position, such that without obstruction the user can slide cards back into the housing while making a selection.

Information stored electromagnetically in the cards, can be damaged by the influence of strong electromagnetic radiation fields. Also cards provided with a RFID chip can be contactlessly read by means of radio waves if they are near an adapted reader. These are two examples of the mostly undesired interaction that can happen between electromagnetic radiation and cards in the housing. An embodiment of the card holder of the invention which excludes these influences has a housing made of a galvanic material. The geometry of the housing of this invention lends itself for fabrication by means of metal extrusion, with which a proper Faraday cage is made.

A possible embodiment which allows further protection from external influences, like moisture and dirt, comprises a housing which can be closed with e.g. a pivoting lid or a flexible part, e.g. a rubber cap.

As was discussed above, the manner in which cards are stored in a wallet can lead to card damage. A possible embodiment of this invention comprises a combination with known storage means like a wallet or money clip, whereby the shortages of prior art storage means relative to card storage are solved, while the card holder is extended with the further functionalities of these different storage means.

BRIEF DESCRIPTION OF THE SEVERAL VIEWS OF THE DRAWINGS

The invention will now be illustrated by way of the drawings:

FIGS. 6, 7 and 8 show possible embodiments of the card remove feature.

DETAILED DESCRIPTION OF THE INVENTION

Figure 1:
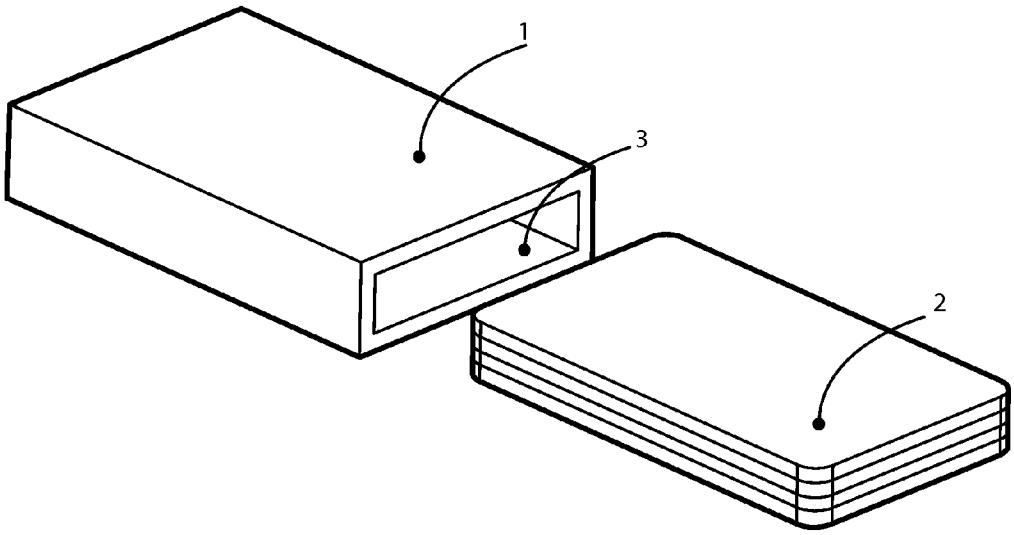
FIGS. 1 and 2 show the main shape and the use of the housing of the card holder of the invention.

FIG. 1 shows a perspective of the housing 1 of the card holder which tightly fits around the adjacent shown stack of at least three cards 2, wherein one of the two smaller pockets of the housing is referred to as a card opening 3 because it is opened to receive and remove cards. The tight fit around the card stack implicates a main shape based on a right angles, but it can of course, for reasons of design or ergonomics, differ, e.g. by providing chamfers, roundings, ribs, etc.

Figure 2:
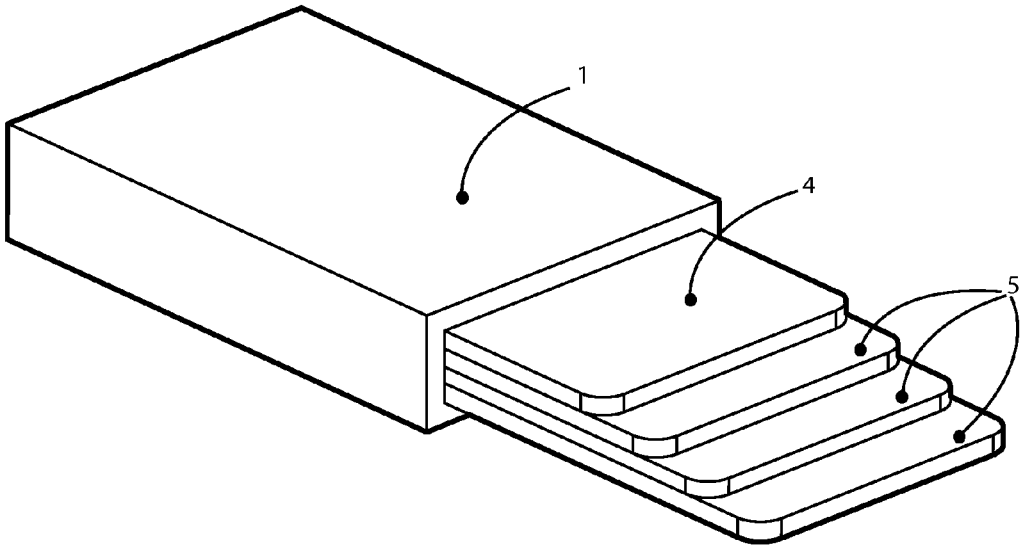

FIG. 2 shows the same housing 1, wherein the card stack is in a step like outward slid position ready for selecting and removing the desired card. Cards often have mutually clear differences regarding colours and print, whereby the user can recognise the desired card on the basis of a small edge for each card. Of the front card 4 a wide strip is visible and free, whereby the user can easily remove this front card by with a finger providing a slight pressure to the front of this card, such that a friction is obtained between finger and card which is bigger than the friction between card and card holder, such that this card can be slid to and fro without effort by the finger and can be taken from the housing.

Of the cards 5 further to the back, narrower strips are visible. If the user desires to view or remove a card 5 further to the back, the front card 4 can simply with the movement of a single finger be slid back into the housing, whereafter the card 5 further to the back can be removed.

Figure 3:
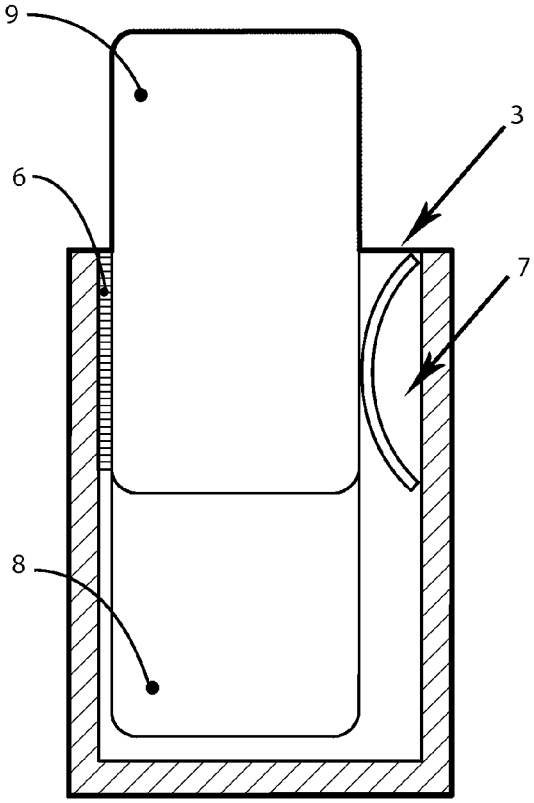
FIGS. 3, 4 and 5 show how the cards obtain a stable position relative to this housing.

FIG. 3 shows a section of a possible embodiment of the housing without details of the card remove feature, wherein one can see how at at least one side near card opening 3 a friction element 6 is located, which bears against a long side of the card stack in the housing. The opposite side in the housing has a resilient element 7 providing that both the completely inward slid cards 8 and the partly outward slid cards 9 bear against the friction element 6 with substantially constant force.

Figure 4:
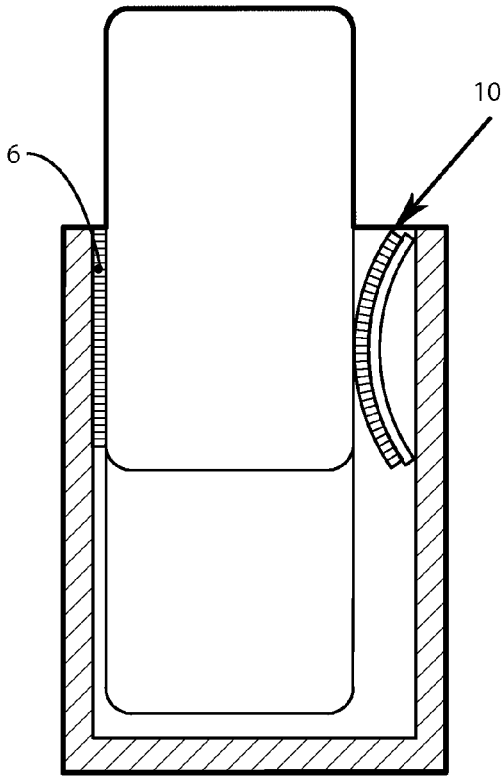

FIG. 4 shows a comparable embodiment with the section of FIG. 3, this time with the friction element and the resilient element at one side integrated within a single resilient friction element 10. Opposite this resilient friction element 10 within the housing a typical friction element 6 can be present. At this location of the friction element 6 a resilient friction element could also be located, but this embodiment is not illustrated.

Figure 5:
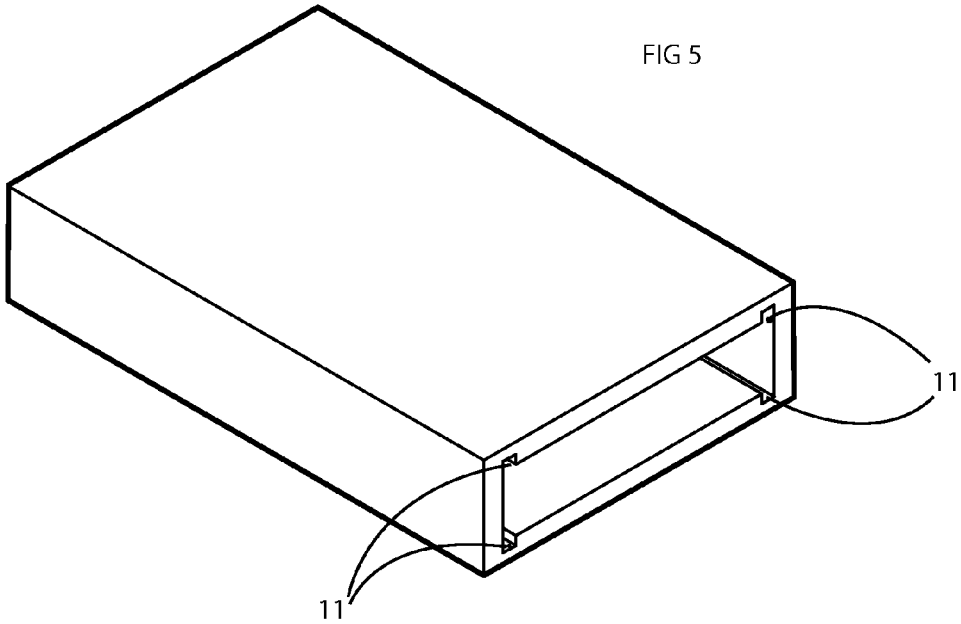

FIG. 5 shows a perspective view of a possible embodiment of the housing of the invention, which is provided with grooves 11 in which the friction element and/or a resilient element of a resilient friction element can be located.

FIG. 6 shows a section of a possible embodiment of the card remove feature based on a recess 12 extending across the front face 13, lower face 14 and back face 15. If the recess in the back face 15 extends further then the recess in the front face 13, both ends of the recess together function as a stop for the finger with which the cards 4, 5 are pushed outside in a step like shape.

FIG. 7 shows a possible embodiment of a housing for a card holder according to the invention, this time shown without friction elements but indeed with a card remove feature in the shape of the stepped element 16 which can rotate around an axis 17 if the user exerts in the rotation direction a force through the actuator 18 outside the housing, or immediately at the operation face 18*a* as part of the stepped element 16. The stepped element is made from steps, wherein the card contact face 19 can exert force against the side of the cards which is perpendicular to the side which bears against the friction element. The card contact faces 19 can be regarded as the thickness of the steps in the stepped shape and the height of these faces is equal to a smaller then the nominal card thickness (approx. 0.8 mm), whereby each step contacts a different card. A reset spring 20 ensures that the stepped element 16 after releasing the operation part returns immediately and automatically to the initial position.

FIG. 8 shows a possible variant of the embodiment of FIG. 7, wherein the stepped element 16 can translate in the direction in which the cards are slid through the card opening 3 and out the housing and which by means of a reset spring 20 after releasing the operation part 18 returns immediately and automatically to the initial position.

Also different embodiments belong to the invention. Features of different in here disclosed embodiments can in different manners be combined and different aspects of some features are regarded mutually exchangeable. All described or in the drawing disclosed features provide as such or in arbitrary combination the subject matter of the invention, also independent from their arrangement in the claims or their referral.

The invention claimed is:

1. A holder for cards, comprising:

a stack of at least three rectangular, mutually-aligned cards;

a housing configured to fit tightly around the stack of cards, said housing comprising at least one card opening for locating and removing the cards;

a card remove feature in said housing, opposite said card opening, provided such that the cards through the card opening can be partly slid from the housing; and a friction element located at at least one inner side of the housing near the card opening, wherein said friction element exerts a friction force on a first side of the stack of cards said first side being defined by a first side of each of the at least three cards, wherein:

said friction element extends along an entire thickness of the at least one inner side of the housing, said friction element is made from at least one of a substrate with a rough fiber surface structure and a felt with metal fibers, said friction element has a friction-exerting surface that is elastically adaptable, and the friction force on the first side of each card in the stack is sufficient to prevent each card from sliding out of the housing due to gravity.

2. The card holder according to claim 1, wherein directly opposite the friction element on a different inner side of said housing, a resilient friction element is located, which is configured to engage a second side of the stack of cards that is opposite the first side of the stack of cards, wherein said friction element and said resilient friction element are configured to respectively engage a side of each card, thereby clamping each card between them.

3. The card holder according to claim 1, wherein said at least on inner side of the housing comprises grooves therein, and wherein said friction element and a resilient element are housed stably together within said grooves, contacting one another.

* * * * *